US005836278A

United States Patent [19]

Scheidt

[11] Patent Number: 5,836,278

[45] Date of Patent: Nov. 17, 1998

[54] DEVICE FOR VARYING THE VALVE CONTROL TIMING OF AN INTERNAL COMBUSTION ENGINE, ESPECIALLY CAMSHAFT SETTING MECHANISM ACCORDING TO THE VANE CELL PRINCIPLE

[75] Inventor: Martin Scheidt, Adelsdorf, Germany

[73] Assignee: Ina Walzlager Schaeffler OHG, Herzogenaurach, Germany

[21] Appl. No.: 7,354

[22] Filed: Jan. 15, 1998

[30] Foreign Application Priority Data

Mar. 4, 1997 [DE] Germany ..... 197 08 661.1

[51] Int. Cl.[6] ..... F01L 1/344

[52] U.S. Cl. ..... 123/90.17; 123/90.31; 74/568 R

[58] Field of Search ..... 123/90.15, 90.17, 123/90.19, 90.31; 74/567, 568 R; 464/1, 2, 160

[56] References Cited

U.S. PATENT DOCUMENTS 4,857,572 8/1989 Shirai et al. ..... 123/90.12

5,450,825 9/1995 Geyer et al. ..... 123/90.17

5,666,914 9/1997 Ushida et al. ..... 123/90.31

*Primary Examiner*—Weilun Lo

*Attorney, Agent, or Firm*—Panitch Schwarze Jacobs & Nadel, P.C.

[57] ABSTRACT

The invention relates in particular to a camshaft setting mechanism according to the vane cell principle, which has a drive gear (1) joined with the crankshaft through a toothed belt or a control chain. The drive gear includes a hollow space (8), and an impeller (11) is installed in the hollow space (8). The impeller is fixedly connected to and rotates with the camshaft (14). The drive gear (1) has at least one working chamber (4) on the interior of its circumferential wall (2), and each vane (12) of the impeller (11) subdivides the working chambers (4) into two pressure areas (9, 10) in each case. To avoid leakage through the slits (13) between impeller (11) and the drive gear (1) at high oil temperatures, the impeller (11) is made of a material which has a higher thermal expansion coefficient than the material of the drive gear (1), and that the pressure areas (9, 10) in the hollow space (7) of the drive gear (1) are sealed off by thermal expansion of the impeller (11) when the motor is in operation.

2 Claims, 1 Drawing Sheet

DEVICE FOR VARYING THE VALVE CONTROL TIMING OF AN INTERNAL COMBUSTION ENGINE, ESPECIALLY CAMSHAFT SETTING MECHANISM ACCORDING TO THE VANE CELL PRINCIPLE

BACKGROUND OF THE INVENTION

The invention relates to a device for varying the valve control timing of an internal combustion engine, especially a camshaft setting mechanism according to the vane cell principle. The invention comprises a drive gear constructed as an outside rotor connected to a crankshaft of the internal combustion engine through a toothed belt or a control chain, which has a hollow space formed by a circumferential wall and two lateral walls. Gearing is provided on the exterior of the circumferential wall, and on the inside of the circumferential wall at least one working chamber is provided having boundary walls which are directed toward the central axis of the drive gear. An impeller constructed as an inside rotor with at least one radial vane is installed in the hollow area of the drive gear and is fixedly connected to and rotates with the camshaft. The vane of the impeller again subdivides each working chamber into two pressure chambers in each case, which selectively allows a relative rotation and/or a continuous hydraulic gripping of the camshaft to the crankshaft through electively time delayed or simultaneous action of pressurized oil.

With the vane cell setting mechanisms of the abovementioned type which are known in the art, the pressure spaces in the hollow area of the drive gear are sealed off against leakage of pressurized oil, which usually takes place through narrow slits between the vanes of the impeller, usually made of steel, and the boundary walls of the drive gear enclosing the pressure areas, usually made of steel of the same quality. Despite the costly exact fit manufacture of such adjusting mechanisms, it has nonetheless been shown that during operation of the motor, leakages occur through the slits based on the increasing temperature of the pressurized oil, due to the thermal expansion of the impeller and the drive gear beyond the original tolerances which provide the inherently necessary limited leakage. This leads to a drop in the oil supply pressure and consequently to delayed adjustment times as well as to a soft hydraulic clamping of the impeller to the camshaft. This has a strongly disadvantageous effect at high oil temperatures, as then the viscosity and the oil supply pressure are particularly small, so that the adjustment position of the camshafts specified by the performance graph of motor control must frequently be reset and/or higher amounts of lubrication oil must be made available. Even at low temperatures at which the pressurized oil has a very high viscosity, the small slit widths have proven to be disadvantageous to the extent that an increased friction occurs between the impeller and the drive gear due to shearing forces in the slits, and the desired adjustment times for the adjusting mechanism cannot be realized immediately.

Furthermore, in DE-OS 39 22 962 a setting mechanism for a camshaft of this type is disclosed in which the vanes of the impeller include axial and radial grooves, and spring actuated seals are located in these grooves which act together with the circumferential wall and the side walls of the hollow space of the drive gear to form a seal.

These sealing measures have, however, proven to be extremely costly with respect to finishing and manufacturing expenses for vane cell setting mechanisms, and likewise still cannot guarantee a satisfactory reduction of leakage values due to the transition area between the individual axial and radial seals.

SUMMARY OF THE INVENTION

It is therefore the object of the invention to provide a device for varying the valve control times of an internal combustion engine, especially a camshaft setting mechanism according to the vane cell principle in connection with which a reliable sealing off of the hollow space of the drive gear against undesired leakage of pressurized oil is achieved with simple, economical means.

The object of the invention is achieved in a camshaft setting mechanism according to the vane cell principle, which has a drive gear constructed as an outer rotor, which is adapted to be joined with a crankshaft of an internal combustion engine through a toothed belt or control chain. The outer rotor includes a hollow space formed by a circumferential wall and two lateral walls, whereby gearing is provided on the exterior of the circumferential wall, and at least one working chamber with boundary walls directed toward the central longitudinal axis of the drive gear is incorporated into the interior of the circumferential wall. An impeller is provided which is constructed as an internal rotor and is adapted to be fixedly connected to and rotates with the camshaft. The impeller has at least one radial vane which is installed in the hollow space of the drive gear. The at least one vane subdivides the at least one working chamber into two pressure areas in each case, such that a relative rotation and/or a continuous hydraulic clamping of the camshaft (14) relative to the crankshaft is obtained by electively time delayed or simultaneous action of pressurized oil in the two pressure areas (9, 10). The impeller is made of a material which has a higher thermal expansion coefficient than a material of the drive gear, such that when the motor is in operation, the pressure spaces in the hollow area of the drive gear are sealed off against leakage through a corresponding expansion of the impeller.

In a preferred embodiment of the invention, the drive gear is preferably made of steel, and the impeller is preferably made of aluminum.

A camshaft setting mechanism constructed in accordance with the invention consequently differs in comparison with the state of the art in that the impeller, which is made of a material with greater thermal expansion, is manufactured slightly smaller than with the previously known steel—steel constructions. This way, enlarged slits between the vanes of the impeller and the boundary walls of the drive gear enclosing the pressure spaces occur so that the shearing forces are diminished in the slits, and consequently the friction between the impeller and the drive gear is reduced. Moreover, the enlarged slits also prove to be advantageous in that the dirt and wear particles (general contamination) deposited during motor operation, thus at predominantly higher oil temperatures, are flushed out through the enlarged slits of the setting mechanism when the motor is started, thus at low oil temperatures.

In contrast, at high oil temperatures, the camshaft setting mechanism constructed in accordance with the invention has the advantage that the impeller expands more than the drive gear owing to its higher thermal expansion coefficient, so that the slits between the vanes of the impeller and the drive gear boundary walls enclosing the pressure areas extremely diminished. The camshaft setting mechanism according to the present invention is consequently in a position with respect to sealing off leakage to adjust itself automatically to the respective viscosity conditions of the pressurized oil, or to counteract the effect of decreasing oil viscosity with rising oil temperatures, and has only the limited leakage of oil under pressure necessary for lubrication purposes.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 2:
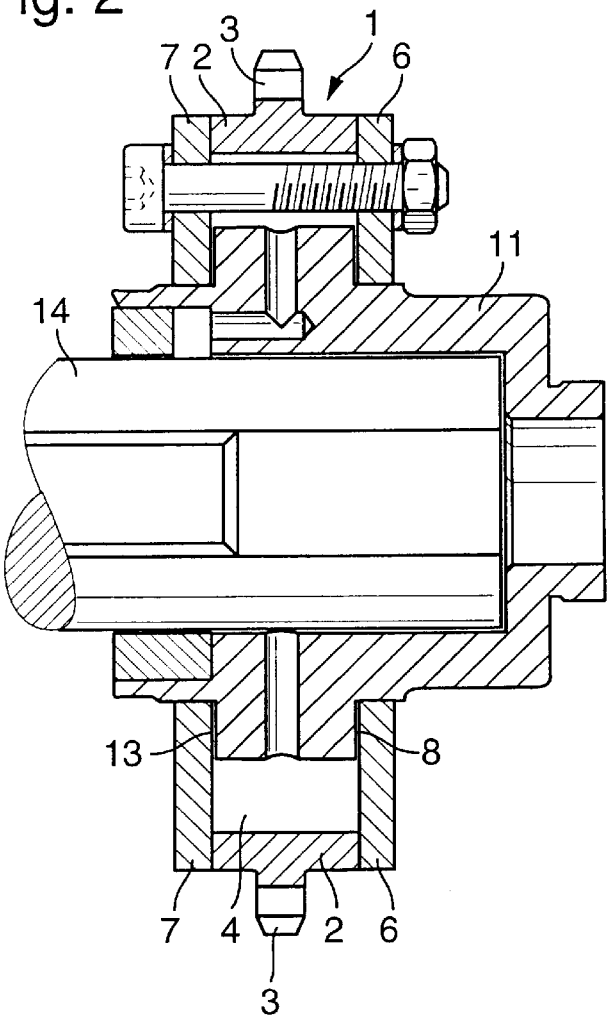
FIG. 2 is a cross-sectional view of the device constructed in accordance with the invention taken along lines 2—2 in FIG. 1.
Figure 1:
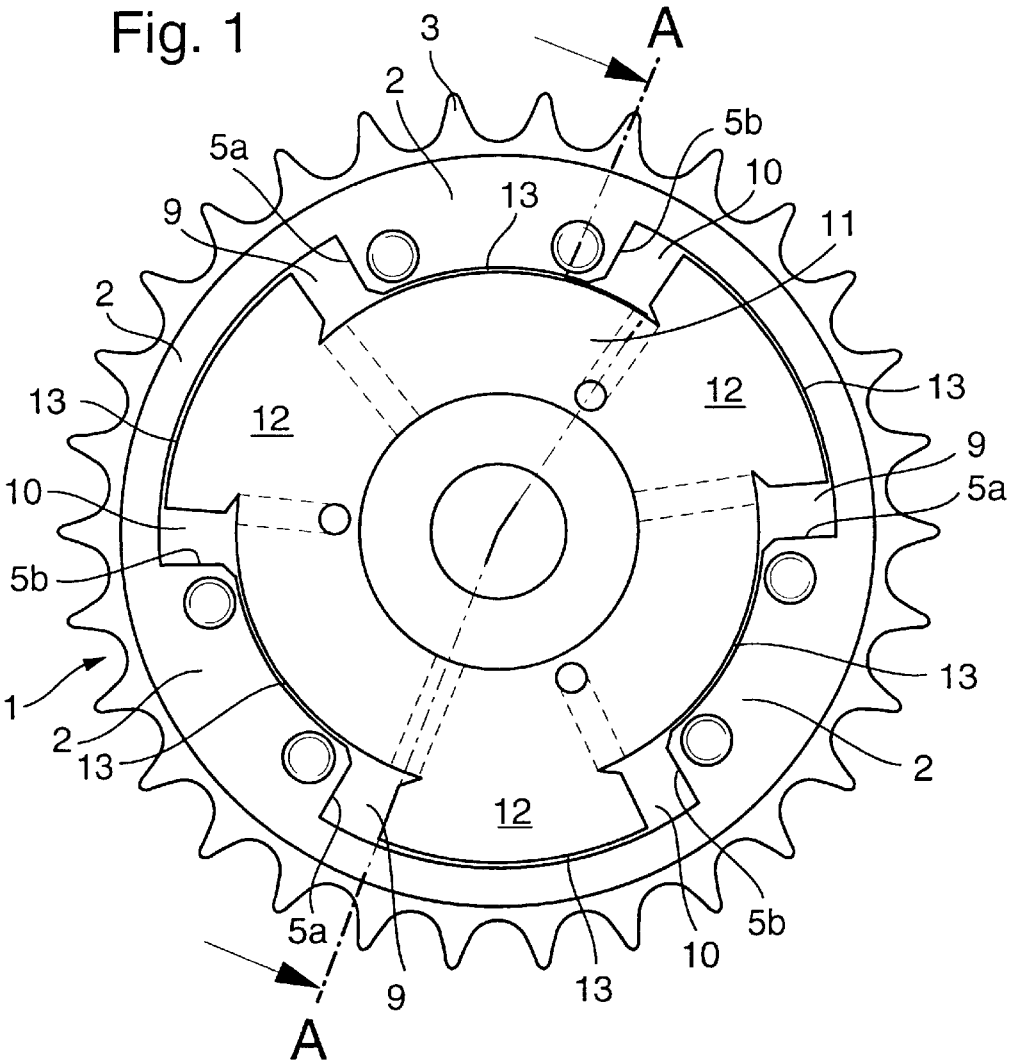
FIG. 1 is a front view of a device constructed in accordance with the invention with the housing cover unscrewed.

FIGS. 1 and 2 show a device for varying the valve control timing of an internal combustion engine as it is known in the field. This device, known as a camshaft setting mechanism according to the vane cell principle, basically comprises a drive gear 1 constructed as an outer rotor, which is connected with a crankshaft of the internal combustion engine by a control chain, and an impeller 11 constructed as an inner rotor which is fixedly connected to and rotates with the camshaft 14.

In the drawings, it can be clearly seen that the drive gear 1 has a hollow space 8 defined by a circumferential wall 2 and two side walls 6, 7, and is constructed with gearing 3 for the control chain on the exterior of the circumferential wall 2. The side walls 6, 7 bounding the hollow space 8, are moreover constructed with an annular ring shape and are fastened parallel to one another on to the drive gear 1 by the screws (shown in the drawings without reference numerals).

As can be seen in FIG. 1, in the preferred embodiment three working chambers 4 are symmetrically incorporated into the interior of the circumferential wall 2 of the drive gear 1, with each working chamber 4 having boundary walls 5*a* and 5*b* which are oriented toward the central longitudinal axis of the drive gear 1, and at the same time subdivide the circumferential wall 2 into likewise symmetrical sections which are provided with the appropriate tappings for attaching the side walls 6, 7 on the drive gear 1.

Installed in the hollow space 8 of the drive gear 1 is an impeller 11, which is constructed in a familiar manner as an internal rotor joined fast with the camshaft 14. Radial vanes 12 are arranged on the periphery of the impeller in the same number and with the same symmetrical division as the working chambers 4 on the drive gear 1. In the assembled condition of the impeller 11, these vanes 12 subdivide each of the working spaces 4 in the drive gear 1 into two pressure spaces 9, 10, which bring about a relative rotation and/or a continuous hydraulic clamping of the camshaft 14 relative to the crankshaft through electively laterally displacing or simultaneous action of pressure with pressurized oil through the oil passages indicated in dotted lines in FIG. 1, but not designated more specifically. The position of the impeller 11 to the drive gear 1 shown in FIG. 1 could at the same time represent a hydraulically fixed middle position of the impeller 11, namely, where pressure chambers 9 as well as pressure chambers 10 are acted upon by a pressure of equal magnitude. In this as well as every other position of the impeller 11, hydraulic short circuits between pressure spaces 9, 10 occur with known devices of the type represented, especially at high temperatures, through the radial slits designated with reference number 13 in FIG. 1 and/or leakages through the lateral slits 13 depicted in FIG. 2.

In accordance with the invention, the impeller 11 for this reason is made of a material with a higher thermal expansion coefficient than the material of the drive gear 1, so that it seals the pressure spaces 9, 10 in the hollow space 8 of the drive gear 1 against leakages and hydraulic short circuits by its expansion during motor operation. In connection with this, making the drive gear 1, which is subjected to high mechanical stress, of a wear resistant steel, and the impeller 11 of aluminum has proven to be especially advantageous; however, other material combinations are also possible where the impeller is made of a material having a higher thermal expansion coefficient than the material of the drive gear.

What is claimed is:

1. A device for varying valve control timing of an internal combustion engine, comprising a camshaft setting mechanism having a drive gear (1) constructed as an outer rotor, which is adapted to be joined with a crankshaft of the internal combustion engine through at least one of a toothed belt and a control chain, the outer rotor including a hollow space (8) formed by a circumferential wall (2) and two lateral walls (6, 7), gearing (3) being located on an exterior of the circumferential wall (2), and at least one working chamber (4) being defined by boundary walls (5*a*, 5*b*) located in an interior of the circumferential wall (2) that are directed toward a central longitudinal axis of the drive gear (1), an impeller (11) constructed as an internal rotor having at least one radial vane (12) which is located in the hollow space (8) of the drive gear (1) which is adapted to be fixedly connected to and rotate with a camshaft (14) of the internal combustion engine, the at least one vane (12) subdivides the at least one working chamber (4) into two pressure areas (9, 10) in each working chamber, such that at least one of a relative rotation and a continuous hydraulic clamping of the camshaft (14) relative to the crankshaft is obtained by at least one of electively time delayed and simultaneous action of pressurized oil in the two pressure areas (9, 10), the impeller (11) being constructed of a material having a higher thermal expansion coefficient than a material of the drive gear (1), such that the pressure areas (9, 10) in the hollow space (8) of the drive gear (1) are adapted to be sealed off against leakage by expansion of the impeller (11) during operation of the engine.

2. Device according to claim 1, characterized in that the drive gear (1) is made of steel, and the impeller (11) is made of aluminum.

* * * * *